US005424698A

United States Patent [19]

Dydyk et al.

[11] Patent Number: 5,424,698

[45] Date of Patent: Jun. 13, 1995

[54] FERRITE-SEMICONDUCTOR RESONATOR AND FILTER

[75] Inventors: Michael Dydyk, Scottsdale; John M. Golio, Chandler, both of Ariz.; Robert J. Higgins, Jr., Plantation, Fla.; Aristotelis Arvanitis, Addison, Ill.

[73] Assignee: Motorola, Inc., Schaumburg, Ill.

[21] Appl. No.: 161,909

[22] Filed: Dec. 6, 1993

[51] Int. Cl.[6] ..... H01P 7/00; H01P 1/218

[52] U.S. Cl. ..... 333/219.2; 333/202

[58] Field of Search ..... 333/202, 204, 219, 219.2, 333/235, 246, 1.1

[56] References Cited

U.S. PATENT DOCUMENTS 4,484,161 11/1984 Barger ..... 333/202

4,679,015 7/1987 Murakami et al. ..... 333/219.2

4,920,323 4/1990 Schloemann et al. ..... 333/1.1

5,309,127 5/1994 Mariani ..... 333/219.2 X

*Primary Examiner*—Seungsook Ham

*Attorney, Agent, or Firm*—Eugene A. Parsons

[57] ABSTRACT

A semiconductor substrate with electronic circuitry (e.g., a transmitter or receiver) formed thereon and including interconnects. A ferrite disk bonded to the substrate so as to interact with the interconnects, when the ferrite disk is activated by a substantially constant magnetic field thereacross, to provide frequency selectivity within the electronic circuitry. A permanent magnet positioned adjacent to the ferrite disk to provide a substantially constant magnetic field across the ferrite disk so that the magnetic field produces resonance in the ferrite disk.

19 Claims, 7 Drawing Sheets

FIG. 4
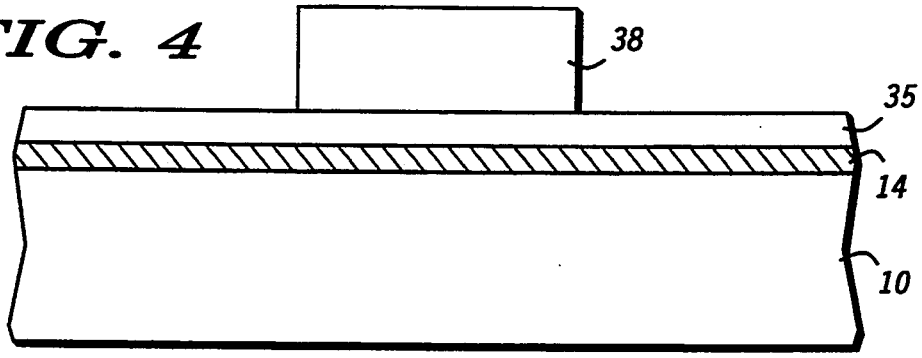
FIG. 5
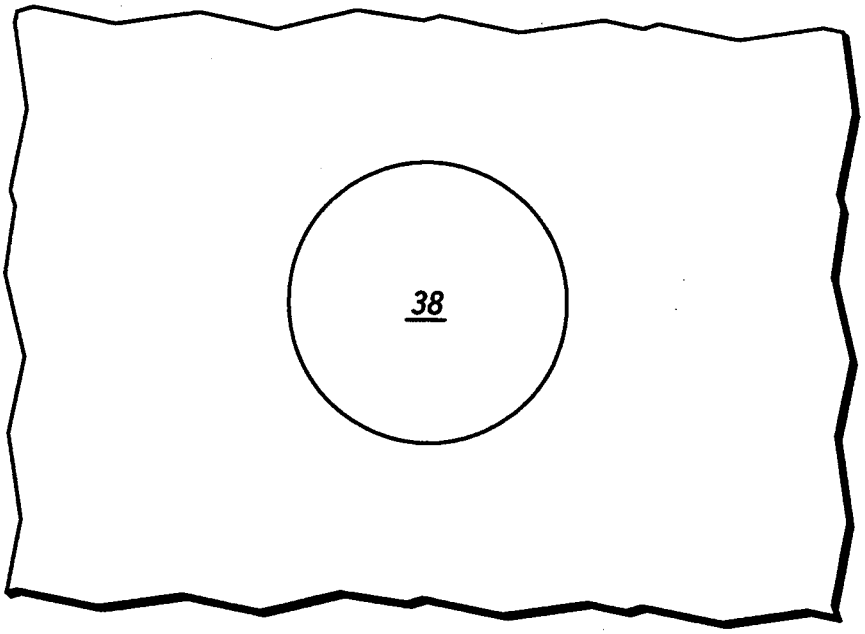
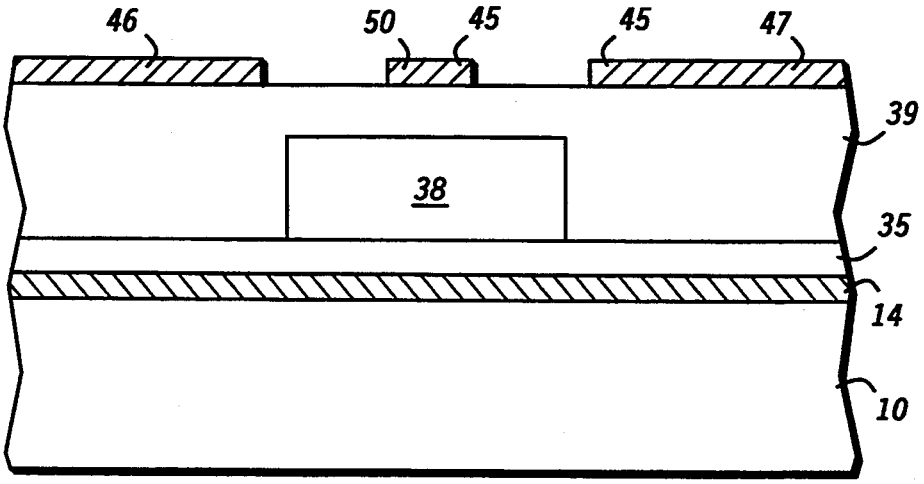
FIG. 6

65

FERRITE-SEMICONDUCTOR RESONATOR AND FILTER

FIELD OF THE INVENTION

The present invention pertains to frequency selective filters for electronic circuits and more specifically to a ferrite-semiconductor resonator formed on a single semiconductor substrate with electronic circuitry.

BACKGROUND OF THE INVENTION

Because filters generally require some type of tuned circuit to provide frequency selectivity, it is very difficult and costly to incorporate filters into integrated circuits, or circuits on semiconductor chips. For example, a standard approach to realizing multi-octave tunable filters is to place tiny ferrite resonators in a magnetic field generated by a solenoid. The size and weight of these filters are primarily determined by the solenoid. The ferrite resonators are spheres which are mounted on rods for ease of handling and orientation. As such, the filters are bulky and very expensive. These structures are definitely not something to be considered for portable applications, such as paging, cellular telephones, etc.

Single crystal yttrium iron garnet (YIG) or gallium-substituted YIG (GaYIG) are magnetic insulators which resonate at a microwave frequency when magnetized by a suitable direct magnetic field. A unique feature of this resonance is that for a spherical YIG configuration, the resonant frequency is only related to the direct magnetic field and not to its dimensions. The basic ferrimagnetic resonance phenomenon can be explained in terms of spinning electrons which create a net magnetic moment in each molecule of a YIG crystal. This electron precession may be used to couple two orthogonal circuits at a microwave signal frequency equal to that of the precession. Using this phenomenon, current controlled tunable microwave filters have been constructed. Multi-octave tuning is in fact readily achieved with such resonators in the 500 MHz to 40 GHz range.

The unloaded Q-factor of these resonators is related to the magnetic and dielectric dissipation (loss tangents) within the YIG material. These losses are fortunately very low. Unloaded Q-factors of the order of 10,000 are realizable using highly polished YIG spheres. Such a value of unloaded Q-factor is indeed nearly as good as that obtainable using conventional waveguide cavities.

The low frequency limit of a YIG resonator is established by the fact that as the frequency is reduced the direct magnetic field required for ferrimagnetic resonance becomes insufficient to align all the magnetic dipoles within the crystal. In this instance, each dipole exhibits a separate resonance absorption, even in the absence of a direct magnetic field. The frequency at which this type of loss first occurs is determined by the magnetization and shape demagnetization of the YIG resonator. The magnetization is reduced through substitution of iron in the YIG crystal with a non-magnetic element such as gallium (GaYIG). Although the linewidth of the GaYIG described is not as good as that of pure YIG, satisfactory operation (using a sphere) is possible at frequencies as low as 360 MHz.

YIG resonators exhibit non-linear microwave losses (limiting) at large signal levels due to the transfer of energy from the uniform mode of magnetization to the so-called spin wave modes. In the usual YIG filter arrangement, first and second order instabilities under perpendicular pumping must be considered separately. In the first order instability (coincidence limiting), the frequency of the pump is twice that of the spinwave mode, whereas, in the second order instability (premature decline limiting), the two frequencies are equal. Coincidence limiting is frequency selective and occurs over a well-defined frequency interval defined by $$\left(\gamma \frac{M_0}{\mu_0}\right) N_t < \omega < \left(2\gamma \frac{M_0}{\mu_0}\right) N_t$$

where:

$\gamma$=the gyromagnetic ratio equal to 2,21*E5 (rad/s)(A/m), $M_0$=the magnetization, $\omega$=the radian frequency, $N_t$=transverse demagnetization factor, and $\mu_0$=the free space permeability.

For pure YIG spheres ($N_t=\frac{1}{3}$) the frequency interval for coincidence limiting lies between 1,660 and 3,320 MHz. The threshold power for coincidence limiting is particularly low and occurs at power levels between −15 dBm and −20 dBm. The critical magnetic field is mainly determined by the uniform and spinwave linewidths and the magnetization of the garnet material. To operate a spherical resonator outside of coincidence limiting a lower ferrite magnetization is necessary. Lower ferrite magnetization means lower Q-factor.

The maximum volume of a YIG sphere is fixed by the excitation of higher order magnetostatic modes within the YIG resonator. The minimum volume is set by the degradation of the unloaded Q-factor due to scattering of the uniform mode into so-called spinwaves via surface irregularities. YIG spheres normally have radii between 0.5 mm and 1.0 mm.

A solid is said to be in the crystalline state if its constituent atoms or groups of atoms are arranged in an angular, periodic array. In a magnetic single crystal the magnetization tends to be directed along certain definite crystallographic axes which, accordingly, are called directions of easy magnetization; the directions along which it is most difficult to magnetize the crystal are called hard directions. Experimentally, it is found that it requires the expenditure of a certain amount of energy to magnetize a single crystal to saturation in a hard direction. The difference between this energy and that required to saturate the crystal along a direction of easy magnetization is known as the anisotropy energy.

Magnetic anisotropy energy modifies Kittel's resonance condition and so this quantity must be recalculated. Since the crystalline energy is dependent upon the orientation of the crystal, the resonant frequency will be dependent upon its orientation in the external direct magnetic field. It is therefore, essential, in a multi-resonator filter to make provisions to align all of the resonators along the same crystallographic axis. It appears from experiments that in most cases the crystal anisotropy is very dependent upon temperature. Consequently, the reasons for mounting the spheres on individual rods, for tweaking purposes, so that the crystal can be oriented in the magnetic field so that temperature effects can be minimized.

Thus, it would be highly desirable to provide ferrite resonators that are small enough to be used in portable devices and especially in portable communication devices.

Accordingly, it is a purpose of the present invention to provide new and improved ferrite resonators which are small enough to be used in portable communications devices.

Further, it is a purpose of the present invention to provide new and improved ferrite resonators which are relatively inexpensive to manufacture.

It is a still further purpose of the present invention to provide new and improved ferrite resonators which are relatively easy to manufacture and to incorporate into high quantity production.

It is another purpose of the present invention to provide new and improved ferrite resonators which allow filters and the like to be integrated into associated circuits on a single chip.

SUMMARY OF THE INVENTION

The above described problems and others are substantially solved and the above purposes and others are realized in a ferrite-semiconductor resonator including a semiconductor substrate with electronic circuitry formed thereon, including interconnects. A ferrite disk is bonded to the semiconductor substrate so as to interact with the interconnects of the electronic circuitry, when the ferrite disk is activated by a substantially constant magnetic field thereacross, to provide frequency selectivity within the electronic circuitry.

The above described problems and others are substantially solved and the above purposes and others are realized in a method of fabricating a ferrite-semiconductor resonator including the steps of providing a semiconductor substrate and forming electronic circuitry on the semiconductor substrate and forming interconnects for the electronic circuitry. A layer of ferrite material is bonded to the substrate in overlying relationship to the electronic circuitry and interconnects and the layer of ferrite material is etched to produce a desired number and shape of ferrite disks. The etching step is further performed to position the ferrite disks relative to the electronic circuitry and interconnects so as to interact with the electronic circuitry to provide frequency selectivity within the electronic circuitry. A permanent magnet is positioned adjacent to the desired number of ferrite disks to provide a substantially constant magnetic field, the magnetic field producing resonance in the desired number of ferrite disks.

BRIEF DESCRIPTION OF THE DRAWINGS

Referring to the drawings:

FIGS. 4 and 5 illustrate sectional and top plan views, respectively, of the intermediate structure of FIG. 3 after the next step in the process has been performed;

FIG. 6 illustrates the ferrite-semiconductor resonator after additional process steps have been performed on the structure of FIG. 4;

DESCRIPTION OF THE PREFERRED EMBODIMENTS

Figure 1:
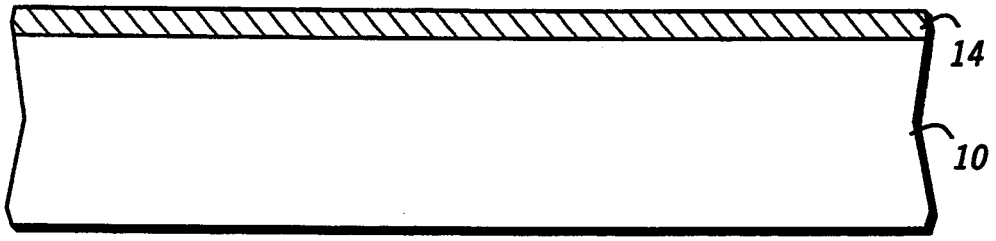
FIGS. 1 and 2 illustrate sectional and top plan views, respectively, of an enlarged portion of a representative metallized interconnect on a semiconductor substrate.
Figure 2:
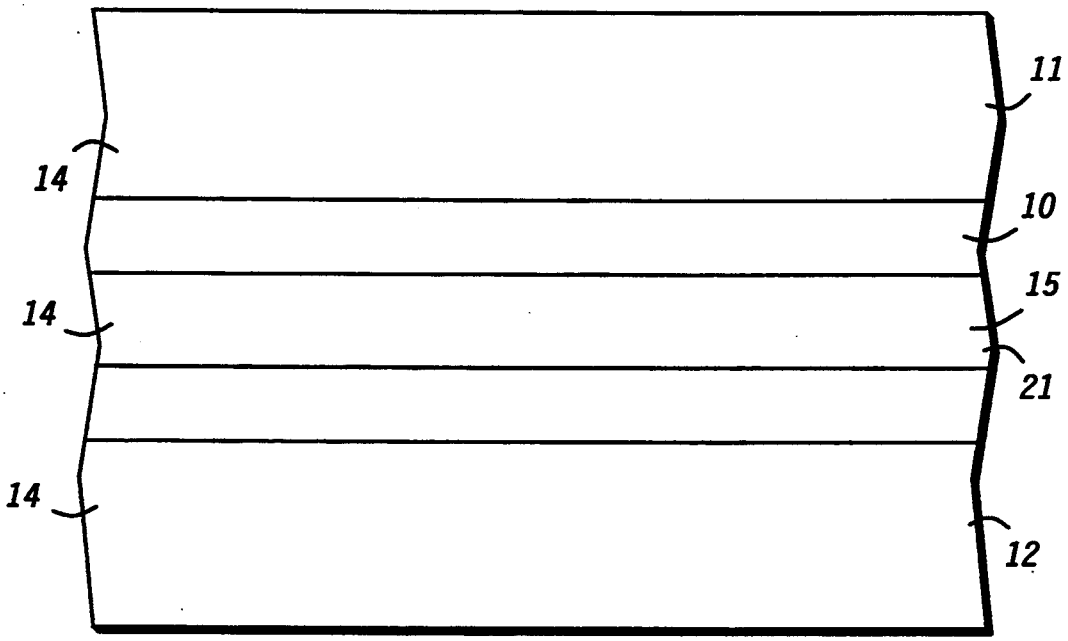

Referring to FIGS. 1 and 2, sectional and top plan views, respectively, of an enlarged portion of a representative metallized interconnect 14 on a semiconductor substrate 10 are illustrated. Interconnect 14 is illustrated for purposes of explanation and is formed as a part of a first metallization layer that includes the entire substrate, as is known in the art. Interconnect 14 includes opposed ground planes 11 and 12 with a center conductor 15 extending therebetween generally parallel with adjacent and spaced apart edges of ground planes 11 and 12. Conductor 15 and ground planes 11 and 12 form what is referred to in the art as a coplanar waveguide. Generally, at least one end of conductor 15 is attached to an electrical circuit (not shown for simplicity) formed in any of the usual processes in semiconductor substrate 10.

Figure 3:
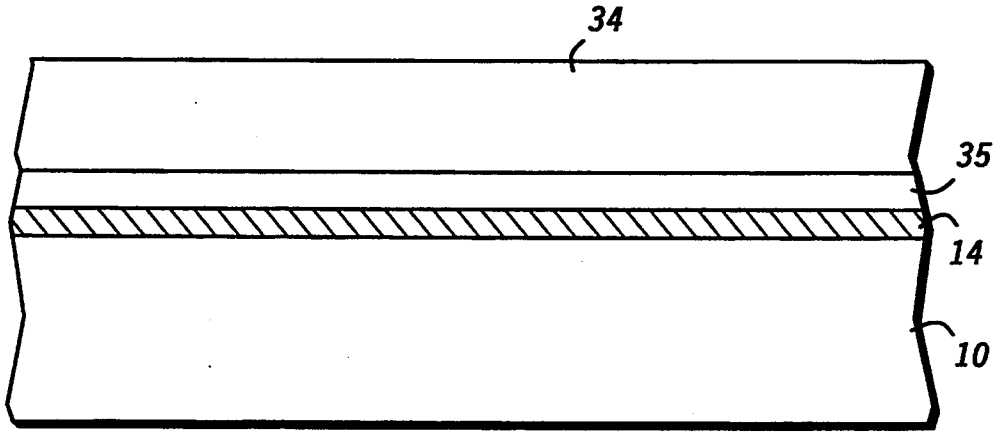
FIG. 3 illustrates an intermediate structure in a process of fabricating a ferrite-semiconductor resonator in accordance with the present invention.

Referring specifically to FIG. 3, an intermediate structure is illustrated in a process of fabricating a ferrite and semiconductor (ferrite-semiconductor) resonator in accordance with the present invention. Semiconductor substrate 10 having interconnect 14 positioned thereon, as illustrated in FIGS. 1 and 2, is utilized. An insulating layer 35 is deposited over interconnect 14 and planarized so as to produce a substantially flat upper surface. Insulating layer 35 is formed of any convenient insulating material which will not adversely affect magnetization circuits to be described presently and may include as an example, silicon oxide or silicon nitride (SiN/Oxide).

Because, as described in the Background above, the crystal anisotropy of ferrites is very dependent upon temperature, crystals of ferrite grown for the present devices generally should be oriented to the proper crystalline axis to minimize temperature sensitivity. The manner of orienting the crystal is known to those skilled in the art, as explained for example in a book entitled "*YIG Resonators and Filters*", pp. 87–88, by J. Helszajn, John Wiley & Sons, 1985. Single crystals of ferrite, grown from flux, are oriented to the proper crystalline axis to minimize temperature sensitivity with the aid of X-ray technology.

The ferrite crystal is then cut into slabs of appropriate thickness, to maintain mechanical integrity, one surface is polished and through electrostatic bonding, for example, one or more slabs 34 are bonded to the upper surface of insulating layer 35, as illustrated in FIG. 3. Generally, the size of ferrite slabs of raw material are small (approximately one inch diameter) compared to wafers of semiconductor substrate material (4 to 6 inches in diameter). Consequently, it may be necessary to bond several ferrite slabs to the larger semiconductor substrate. With the required number of ferrite slabs fixedly bonded to insulating layer 35, the ferrite is thinned down to a desired thickness and the surface is polished. Generally, the ultimate thickness of ferrite layer 34 will be in the range of approximately 1–5 millimeters but may be thicker or thinner for specific applications.

Ferrite layer 34 is then masked in any of the well known processes and by some convenient etching process, such as reactive ion etching (RIE), is formed into a desired shape and number of ferrite disks 38. A single ferrite disk 38 is illustrated in side elevation in FIG. 4 and in top plan in FIG. 5 to show one potential embodiment. It should be understood that, while a circular shape is illustrated in FIGS. 4 and 5, that virtually any geometric shape which will perform the desired functions can be utilized. In general, ferrite disk 38 has a diameter in the range of 10–20 millimeters but larger or smaller diameters can be utilized in specific applications. Each ferrite disk can have a different shape and can even have holes etched therethrough to reduce spurious signals in the electrical output of the filter. The etching process also positions ferrite disk 38 in the correct position relative to interconnect 14, as will be explained in more detail presently. As a potential alternative to the above described process of bonding ferrite disks to a semiconductor substrate, ferrite thin films can be selectively deposited, or deposited and selectively etched, directly onto a thin insulating layer on the substrate.

Once ferrite disk 38 is completed and properly positioned, the entire structure is covered with an insulating layer 39, as illustrated in FIG. 6. Insulating layer 39 is deposited over ferrite disk 38 and planarized so as to produce a substantially flat upper surface. Insulating layer 39 is formed of any convenient insulating material which will not adversely affect magnetization circuits to be described presently and may include as an example, silicon oxide or silicon nitride (SiN/Oxide). Vias, or openings, are then provided in a known manner through insulating layer 39 to any connections required to interconnect 14, or the metallization layer in which interconnect 14 is formed. A second metallization layer is then deposited on the surface of insulating layer 39 and through the vias to connect the second metallization layer to the first metallization layer at selected points through the vias.

In this specific example, the second metallization layer defines an interconnect 45, which includes two horizontally spaced apart ground planes 46 and 47 and a central conductor 50 forming a coplanar waveguide, as previously described. Further, conductor 50 of interconnect 45 extends approximately orthogonal to conductor 15 of interconnect 14 and on an opposite side of ferrite disk 38, so that ferrite disk 38 is positioned therebetween at the cross-over area, as illustrated in top plan in FIG. 7.

Figure 8:
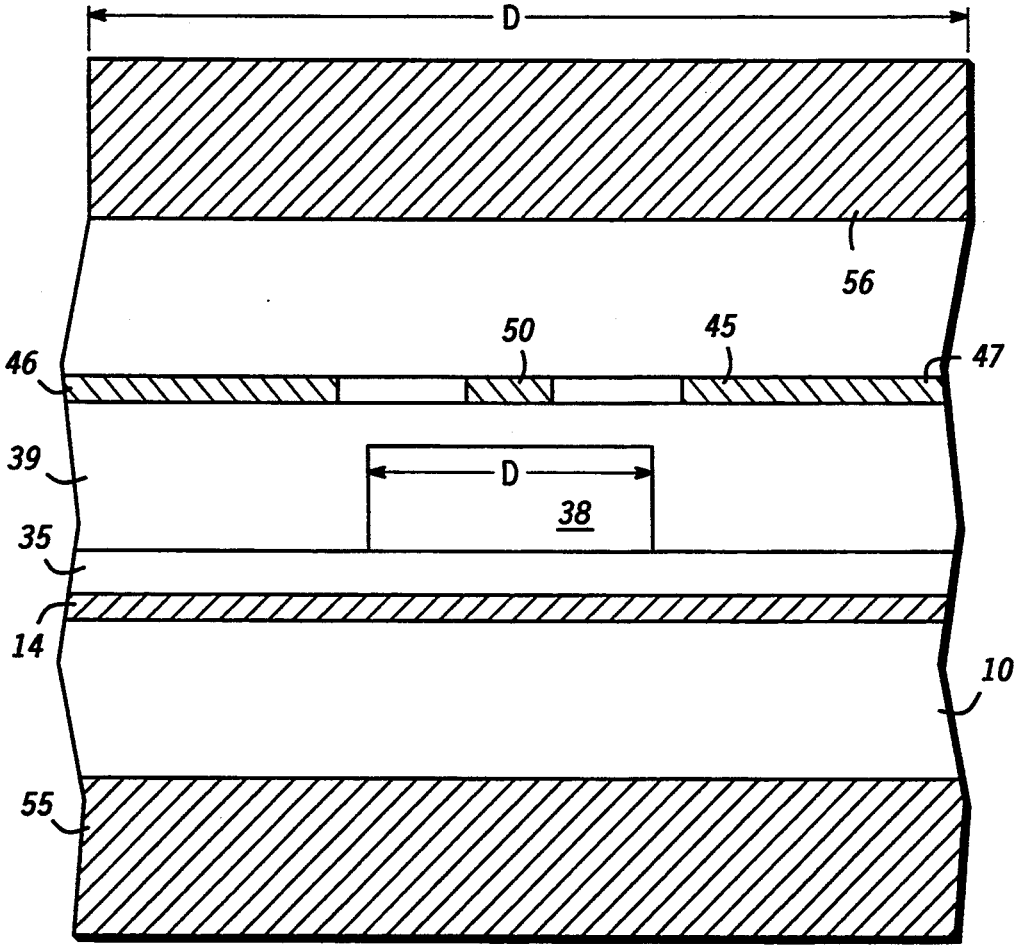
FIG. 8 is an enlarged sectional view of a ferrite-semiconductor resonator in accordance with the present invention.

To complete the resonator filter, a permanent magnet is positioned adjacent to ferrite disk 38 to provide a substantially constant magnetic field across ferrite disk 38 so that the magnetic field produces resonance in ferrite disk 38. In an embodiment illustrated in FIG. 8, the permanent magnet includes first and second flat members 55 and 56 of magnetic material. At least one of members 55 and 56 is permanently magnetized to provide the required magnetic flux. First flat member 55 is positioned in abutting engagement and parallel with the lower, or reverse, side of substrate 10 and second flat member 56 is positioned adjacent to and parallel with the upper surface of ferrite disk 38. Thus, a magnetic field is set up which extends between members 55 and 56.

Generally, upper member 56 is spaced from interconnect 45 and the upper surface of ferrite disk 38 the same distance as lower member 55 is spaced from interconnect 14 and the lower surface of ferrite disk 38 to insure uniformity of the electric field on interconnects 14 and 45. Also, as a general rule, the horizontal dimensions, represented by "D", of the permanent magnet (e.g., member 56) are approximately twice the horizontal dimensions, represented by "d", of ferrite disk 38 to ensure that the magnetic field across ferrite disk 38 is substantially uniform. The same rule applies when more than one ferrite disk is utilized in a resonator and the distance "d" represents the horizontal distances of all of the ferrite disks. The purpose of the additional size of the permanent magnet is to keep ferrite disk 38 away from the fringing effect of the magnetic field near the edges of the permanent magnet, which is a nonuniform magnetic field, and any size of permanent magnet which accomplishes this result is sufficient. With a substantially constant magnetic field across ferrite disk 38, the magnetic field produces resonance in ferrite disk 38 and signals flowing in either interconnect 14 or 45 at the resonant frequency are coupled through ferrite disk 38 into the other of interconnects 45 or 14.

The specific frequency about which the resonance of ferrite disk 38 is centered depends primarily on the strength of the magnetic field produced by the permanent magnet. At the present time, magnetic material is available on the market which can be magnetized to a desired strength to produce a resonance in ferrite disk 38 in the range of approximately 60 MHz to approximately 40 GHz. The lower frequencies are achieved in the present structure because thin cylindrical or rectangular ferrite disks are utilized. Further, because of the thin cylindrical or rectangular configurations, yttrium iron garnet (YIG) material can be used for ferrite disk 38, which results in a higher Q-factor. Because permanent magnets are utilized in the described resonator filters to produce the constant magnetic field, rather than prior art solenoids and the like, the size of the present resonator filters is substantially reduced. For example,the size of a four resonator ferrite filter is reduced by three orders of magnitude in volume (from a one inch cube to a $10^{-3}$ inch cube).

Figure 7:
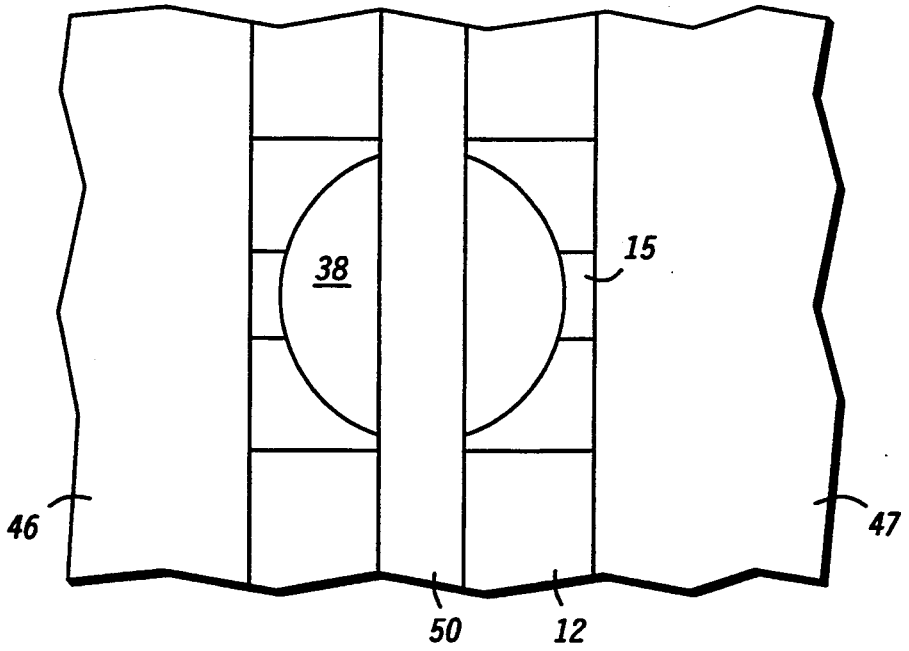
FIG. 7 is a view in top plan of the structure of FIG. 6, with hidden components illustrated in broken lines to illustrate the relationship therebetween.
Figure 9:
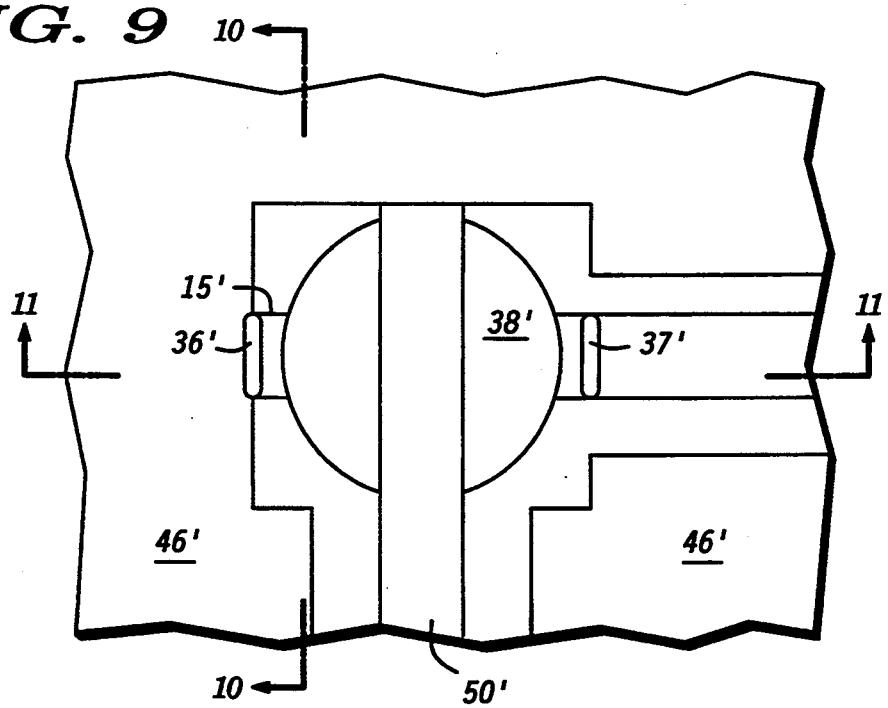
FIG. 9 is a view similar to FIG. 7 of a different embodiment.
Figure 10:
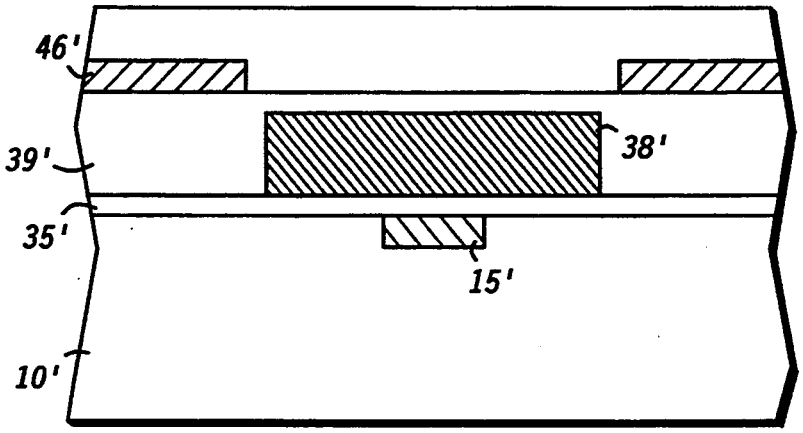
FIG. 10 is an enlarged sectional view as seen from the line 10—10 in FIG. 9.
Figure 11:
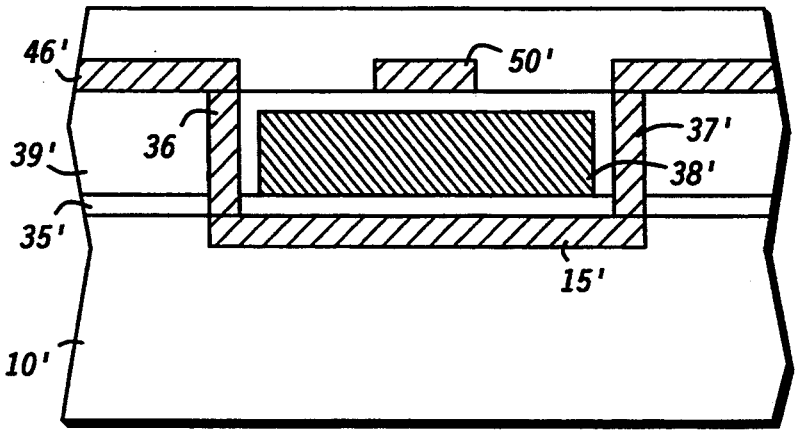
FIG. 11 is an enlarged sectional view as seen from the line 11—11 in FIG. 9.

An embodiment of a ferrite-semiconductor resonator, resonator/filter, different than that illustrated in FIG. 7, is illustrated in FIGS. 9, 10 and 11. In this structure, components similar to those illustrated in FIG. 7 are designated with similar numbers and have a prime added to indicate the different embodiment. In this embodiment, substrate 10' represents a semiconductor chip having an integrated circuit (not shown) formed therein in the usual manner. A metallization layer normally formed on substrate 10' to provide external electrical connections to the various circuits of the integrated circuit is also utilized to form a center conductor 15'. Center conductor 15' extends beneath ferrite disk 38' and beyond the edges thereof a short distance. Ferrite disk 38′ is insulated from center conductor 15′ by a thin insulating layer 35′ and contained within an insulating layer 39′, as previously described. A pair of vias 36′ and 37′ are formed through insulating layer 39′ and into contact with the upper surface of center conductor 15′ at each end thereof. A second metallization layer 46′ is positioned on top of insulating layer 39′ and forms a ground plane which includes center conductor 50 positioned in overlying relationship to ferrite disk 38′. Second metallization layer 46′ also metallizes vias 36′ and 37′ so that electrical connections are made from second metallization layer 46′ to each end of center conductor 15′. Thus, center conductor 15′ is spaced horizontally between edges of second metallization layer 46′ and is also spaced vertically in a different but parallel plane from the plane of second metallization layer 46′ (see specifically FIG. 10). Even though center conductor 15′ lies in a slightly different plane from second metallization layer 46′, which is the ground plane, this configuration is referred to as a coplanar waveguide in the art.

Figure 12:
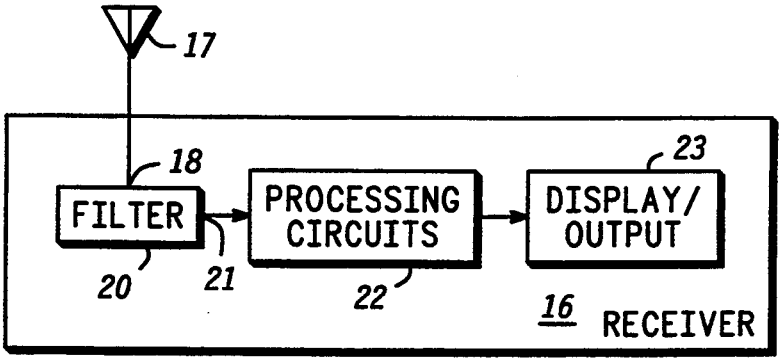
FIGS. 12 and 13 are simplified block diagrams of a communications receiver and a communications transmitter, respectively, incorporating ferrite-semiconductor resonator type filters filters in accordance with the present invention.
Figure 13:
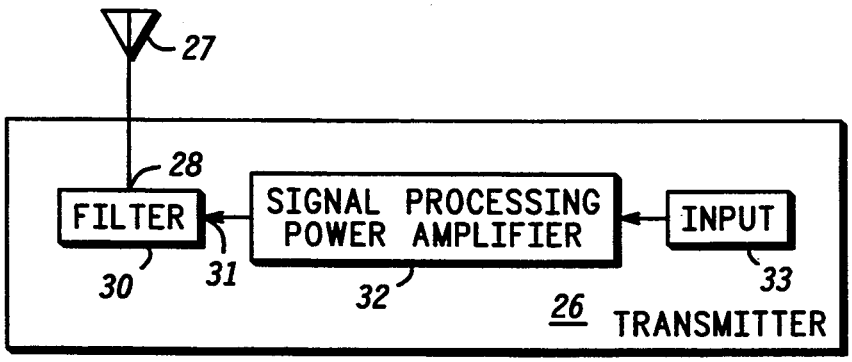

Referring to FIG. 12 for example, a receiver 16 includes an antenna 17 connected to an input 18 of a frequency selective resonator type filter 20. An output 21 of resonator type filter 20 is connected to signal processing circuitry 22 which has a usual display/output device 23 connected thereto. Similarly, FIG. 13 illustrates a communications transmitter 26 including an antenna 27 connected to an output 28 of a frequency selective resonator type filter 30. An input 31 of resonator filter 30 is connected to signal processing and power amplifier circuitry 32 which has a usual display/input device 33 connected thereto. One end, designated 21, of conductor 15 in FIG. 2 serves as output 21 of filter 20 in FIG. 12, or input 31 of FIG. 13 and is connected to the signal input of processing circuits 22 or signal processing and power amplifier circuitry 32 which are designed to receive or transmit only a selected range of frequencies. The opposite end of conductor 15 is connected to a termination circuit as, for example, ground. At least one end of central conductor 50 is connected to an electrical circuit and serves, in this embodiment, as an input. For example, input 18 of FIG. 12 or input 31 of FIG. 13 is one end of central conductor 50 and is connected to antenna 17 or signal processing and power amplifier circuit 32, respectively. The thickness of insulating layers 35 and 39 is dependent primarily on the required coupling between interconnect 14 and 45. Generally, the thickness of insulating layers 35 and 39 can be the minimum which can be accurately and reliable deposited. To provide a degree of freedom, the coupling can also be controlled by the width of conductors 15 and 50. In the specific embodiment described, antenna 17 (FIG. 12) is connected to central conductor 50 of interconnect 45 and central conductor 15 of interconnect 14 is connected to the input of processing circuits 22. Thus, a specific frequency, or band of frequencies, is filtered out of signals received by antenna 17.

Figure 14:
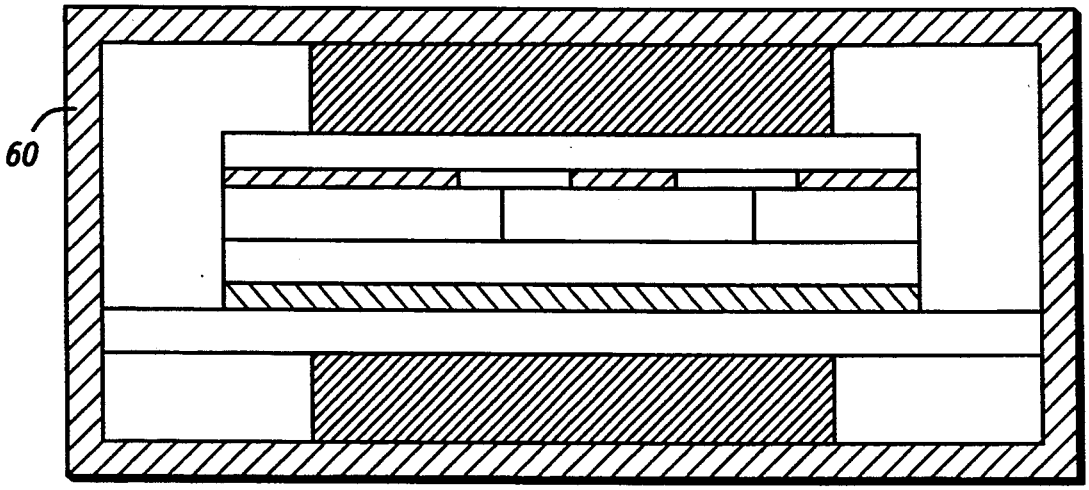
FIG. 14 is a sectional view of another embodiment of a ferrite-semiconductor resonator.

To ensure that outside magnetic fields, such as the earths magnetic field, do not affect the resonant frequency of ferrite disk 38, an embodiment is illustrated in a simplified diagram in FIG. 14. In this embodiment a housing 60 of material having a high magnetic permeance is constructed to substantially completely surround the entire structure. This can be accomplished in one example utilizing receiver 16 of FIG. 12, by simply mounting receiver 16 within a housing formed of material having a high magnetic permeability or by coating the normal housing with a thin coating of material having a high magnetic permeability.

Figure 15:
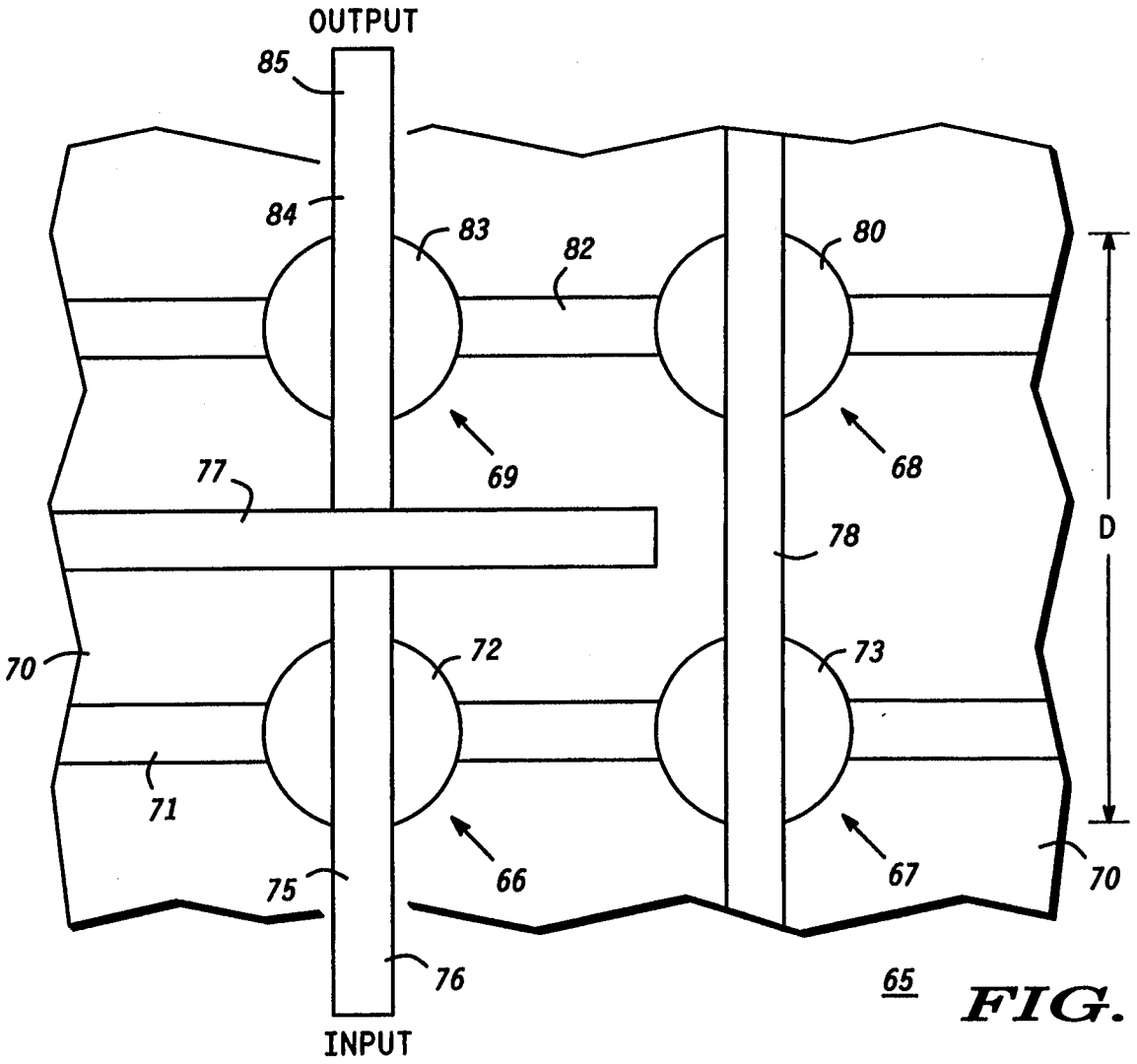
FIG. 15 is an enlarged view in top plan of a resonator filter including a plurality of ferrite resonators.

Referring specifically to FIG. 15, an enlarged view in top plan of a resonator filter 65 including a plurality of ferrite resonators 66, 67, 68 and 69 formed generally into a square configuration. In the ferrite resonators the interconnects associated with each ferrite resonator is depicted as simply a pair of orthogonal conductors for simplifying the drawing and the description, but it will be understood that ground planes and other connections are included in the usual manner. Further, a ground plane 70 (illustrated as a single line for simplicity) surrounds resonator filter 65 in this embodiment. Ferrite resonator 66 includes a first conductor 71 extending from ground plane 70 under a ferrite disk 72 of ferrite resonator 66 and further extending under a ferrite disk 73 of ferrite resonator 67 to the opposite side of ground plane 70. A second conductor 75 of ferrite resonator 66 has an input end 76 extending through an opening in ground plane 70. Conductor 75 extends across ferrite disk 72 orthogonal to conductor 71 and to a ground plane 77 extending from ground plane 70 between ferrite resonators 66 and 69. Ferrite resonator 67 includes a second conductor 78 which extends from ground plane 70 across ferrite disk 73 orthogonal to conductor 71 and across a ferrite disk 80 of ferrite resonator 68 to the opposite side of ground plane 70. Ferrite resonator 68 includes a second conductor 82 which extends from ground plane 70 beneath ferrite disk 80 orthogonal to conductor 78 and beneath a ferrite disk 83 of ferrite resonator 69 to ground plane 70 on the opposite side. A second conductor 84 of ferrite resonator 69 has an output end 85 which extends outwardly from ferrite resonator 69 through an opening in ground plane 70. Conductor 84 further extends across ferrite disk 83 into contact with ground plane 77. It should be understood that resonator filter 65 can be constructed: with conductors 75, 78 and 84 lying in the same plane as ground plane 70 and conductors 71 and 82 connected by vias, as described in conjunction with FIGS. 9–11; conductors 71 and 82 lying in the same plane as ground plane 70 and conductors 75, 78 and 84 connected by vias; or two separate ground planes connected by vias can be provided with conductors 71 and 82 lying in a plane with one ground plane and conductors 75, 78 and 84 lying in a plane with the other ground plane (as shown).

When the ferrite disks 72, 73, 80 and 83 are activated by a substantially constant magnetic field thereacross, as previously explained, each ferrite resonator 66, 67, 68 and 69 becomes frequency selective. Signals within the resonant frequency band applied to input 76 will be coupled from conductor 75 to conductor 71. Signals within the resonant frequency band appearing on conductor 71 will be coupled to conductor 78. Signals within the resonant frequency band appearing on conductor 78 will be coupled to conductor 82 and from there to conductor 84 where they will appear at output 85. In general, if resonator filter 65 is activated by a common permanent magnet, each ferrite resonator will be frequency selective to the same range or band of frequencies. However, each ferrite resonator will add additional filtering. It will of course be understood that more or less ferrite resonators can be combined in similar ferrite filters to provide the amount of filtering ultimately desired.

Figure 16:
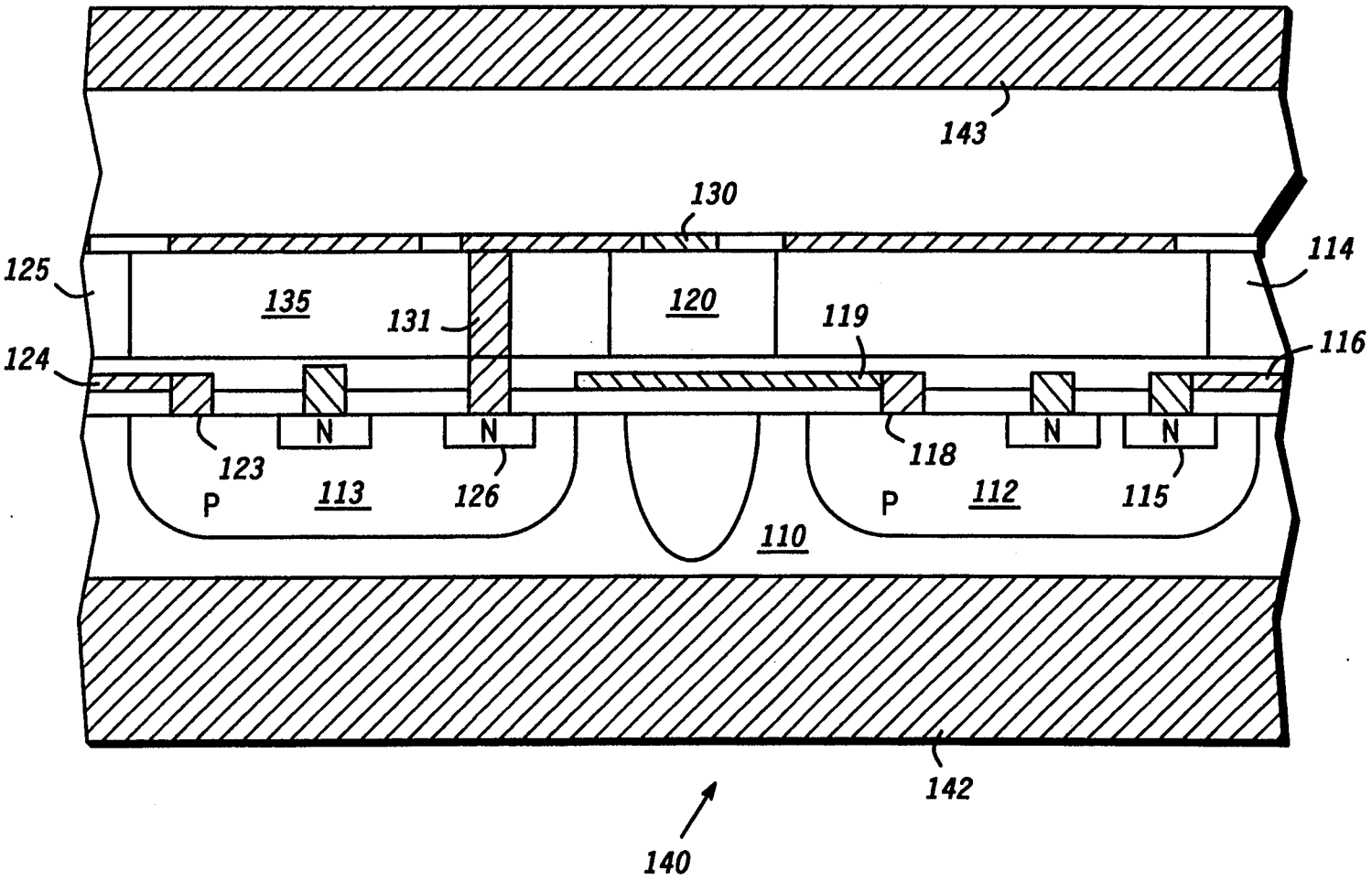
FIG. 16 is an enlarged sectional view of a plurality of ferrite-semiconductor resonators in accordance with the present invention, portions thereof broken away.

Referring specifically to FIG. 16, a ferrite/semiconductor resonator/filter 100 is illustrated which includes a semiconductor substrate 110 and electronic circuitry represented by bipolar transistors 112 and 113. Transistors 112 and 113 are formed on semiconductor substrate 110 utilizing usual methods and are illustrated herein in a simplified embodiment for purposes of explanation. A collector 115 of transistor 112 is coupled to an interconnect 116 extending beneath a ferrite disk 114, which is only partially illustrated. A base 118 of transistor 112 is coupled to an interconnect 119, which extends beneath a ferrite disk 120. Ferrite disk 120 is bonded to substrate 110 as previously described. A base 123 of transistor 113 is coupled to an interconnect 124 extending beneath a ferrite disk 125, which is only partially illustrated. A collector 126 of transistor 113 is coupled to an interconnect 130, above ferrite disk 120 and orthogonal to interconnect 119, by means of a metallized via 131 extending through an insulating layer 135. A permanent magnet, generally designated 140 includes first and second flat members of magnetic material 142 and 143, at least one of which is permanently magnetized. Flat member 142 is positioned adjacent to and parallel with the lower or reverse side of substrate 110 and flat member 143 is positioned adjacent to and parallel with an upper end of ferrite disks 114,120 and 125. In this embodiment, permanent magnet 140 is positioned adjacent to the plurality of ferrite disks 114, 120, 125 to provide a substantially constant magnetic field across all of the plurality of ferrite disks. It should be understood that the area covered by permanent magnet 140 is substantially larger than the area covered by ferrite disks 114, 120 and 125 and so that no ferrite disk is positioned in the fringes of the magnetic field to ensure a constant magnetic field across each of the ferrite disks.

Interconnects 116, 119 and 124 are formed at the same time as metal terminals for the various electrodes of transistors 112 and 113 in the normal steps of metallizing and etching substrate 110. Insulating layers 135 and others, as well as the metal layer including conductor 130 and metallized via 131 are formed as previously described with ferrite disks being formed and bonded as previously described. While the circuitry and connections of FIG. 16 are only intended to be representative, it can be seen by those skilled in the art that virtually the entire electronic circuitry of, for example, communication receiver 16 of FIG. 12 and/or communication transmitter 26 of FIG. 13 can be positioned on a single semiconductor substrate utilizing ferrite-semiconductor resonator type filters in accordance with the present invention.

Thus, ferrite-semiconductor resonators and/or filters that are small enough to be used in portable devices and especially in portable communication devices have been disclosed. This is possible because the size of the ferrite resonators is substantially reduced and they can be incorporated directly onto semiconductor substrates. Further, the new and improved ferrite-semiconductor resonators and/or filters are relatively easy and inexpensive to manufacture and to incorporate into high quantity production. This is true because planar ferrite disks are used in the ferrite resonators and standard photolithography is used throughout the process of fabrication. Also, the new and improved ferrite-semiconductor resonators and/or filters allow filters and the like to be integrated into associated circuits on a single chip.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A ferrite-semiconductor resonator comprising:
a semiconductor substrate;
electronic circuitry formed on the semiconductor substrate and including interconnects; and
a ferrite disk bonded to the semiconductor substrate by insulating material so as to be insulated from the electronic circuitry and to interact with the interconnects of the electronic circuitry, when the ferrite disk is activated by a substantially constant magnetic field thereacross, to provide frequency selectivity within the electronic circuitry.

2. A ferrite-semiconductor resonator as claimed in claim 1 including in addition a permanent magnet positioned adjacent to the ferrite disk to provide a substantially constant magnetic field across the ferrite disk, the magnetic field producing resonance in the ferrite disk.

3. ferrite-semiconductor resonator as claimed in claim 2 wherein the permanent magnet has a dimension generally parallel to the substrate and the ferrite disk has a dimension in the same direction, the dimension of the permanent magnet being at least twice the dimension of the ferrite disk.

4. A ferrite-semiconductor resonator as claimed in claim 2 including in addition a plurality of ferrite disks bonded to the semiconductor substrate by insulating material so as to be insulated from the electronic circuitry and to interact with the interconnects of the electronic circuitry when the ferrite disks are activated by a substantially constant magnetic field thereacross, to provide frequency selectivity within the electronic circuitry, the permanent magnet being positioned adjacent the plurality of ferrite disks to provide a substantially constant magnetic field across all of the plurality of ferrite disks.

5. A ferrite-semiconductor resonator as claimed in claim 4 wherein the permanent magnet has a dimension generally parallel to the substrate and the plurality of ferrite disks have a combined dimension in the same direction, the dimension of the permanent magnet being at least twice the dimension of the ferrite disks.

6. A ferrite-semiconductor resonator as claimed in claim 1 wherein the ferrite disk is a thin film of ferrite material formed on an insulating layer, which insulating layer is in turn formed on the substrate.

7. A ferrite-semiconductor resonator comprising:
a semiconductor substrate;
electronic circuitry formed on the semiconductor substrate and including interconnects;
a first layer of insulating material formed on the substrate; and
a ferrite disk positioned on the first layer of insulating material and bonded to the semiconductor substrate by the layer of insulating material so as to interact with the interconnects of the electronic circuitry, when the ferrite disk is activated by a substantially constant magnetic field thereacross, to provide frequency selectivity within the electronic circuitry and a second layer of insulating material deposited thereover.

8. A ferrite-semiconductor resonator as claimed in claim 7 including in addition a first interconnect positioned between the substrate and the first layer of insulating material and a second interconnect overlying the second layer of insulating material, the first and second interconnects being electrically coupled to the electronic circuitry interconnects.

9. A ferrite-semiconductor resonator as claimed in claim 8 wherein the first and second interconnects are each coplanar waveguides.

10. A ferrite-semiconductor resonator as claimed in claim 7 wherein the first and second layers of insulating material include one of SiN or SiO.

11. A ferrite-semiconductor resonator as claimed in claim 1 wherein the ferrite disk includes a crystalline ferrite material oriented to a predetermined crystalline axis to minimize temperature sensitivity.

12. A ferrite-semiconductor resonator as claimed in claim 1 wherein the electronic circuitry includes one of a communication transmitter and a communication receiver.

13. A ferrite-semiconductor resonator as claimed in claim 12 including in addition a housing having the substrate mounted therein and a permanent magnet mounted in the housing and positioned adjacent to the ferrite disk to provide a substantially constant magnetic field across the ferrite disk, the magnetic field producing resonance in the ferrite disk.

14. A ferrite-semiconductor resonator as claimed in claim 13 wherein the permanent magnet includes first and second flat members of magnetic material, at least one of which is permanently magnetized, with the first flat member being positioned adjacent to and parallel with a reverse side of the substrate and the second flat member being positioned adjacent to and parallel with the ferrite disk.

15. A ferrite-semiconductor resonator as claimed in claim 14 wherein the first flat member is positioned in abutting engagement with the reverse side of the substrate and the second flat member is spaced from the ferrite disk approximately the same amount as the first flat member.

16. A ferrite-semiconductor resonator as claimed in claim 13 wherein the housing includes material with relatively high magnetic permeability at least partially surrounding the permanent magnet.

17. A ferrite-semiconductor resonator comprising:

a semiconductor substrate having first and second major surfaces;

electronic circuitry formed on the first major surface of the semiconductor substrate and including interconnects;

an insulating layer formed over at least portions of the electronic circuitry and the interconnects;

a ferrite disk bonded to the insulating layer so as to interact with the interconnects of the electronic circuitry, when the ferrite disk is activated by a substantially constant magnetic field thereacross, to provide frequency selectivity within the electronic circuitry; and a permanent magnet positioned adjacent to the ferrite disk, the permanent magnet including first and second flat members of magnetic material, at least one of which is permanently magnetized, with the first flat member being positioned in abutting engagement with and parallel to the second major surface of the substrate and the second flat member being positioned adjacent to and parallel with the ferrite disk to provide a substantially constant magnetic field across the ferrite disk, the magnetic field producing resonance in the ferrite disk.

18. A ferrite-semiconductor resonator as claimed in claim 17 wherein the ferrite disk is formed from a crystalline ferrite material oriented to a predetermined crystalline axis to minimize temperature sensitivity.

19. A ferrite-semiconductor resonator as claimed in claim 18 wherein the electronic circuitry includes first and second spaced apart interconnects with the first interconnect positioned between the substrate and the insulating layer and the second interconnect overlying the ferrite disk, and the resonator further including a second layer of insulating material positioned between the ferrite disk and the second interconnect, the first and second interconnects being electrically coupled to the electronic circuitry interconnects.

* * * * *